US006601640B1

(12) United States Patent
Staffa et al.

(10) Patent No.: US 6,601,640 B1
(45) Date of Patent: Aug. 5, 2003

(54) HEAT TRANSMISSION UNIT FOR A MOTOR VEHICLE

(75) Inventors: Karl-Heinz Staffa, Stuttgart (DE); Hans-Joachim Krauss, Stuttgart (DE); Hagen Mittelstrass, Bondorf (DE); Christoph Walter, Stuttgart (DE); Bernd Dienhart, Cologne (DE)

(73) Assignee: Behr GmbH & Co., Stuttgart (DE)

( * ) Notice: Subject to any disclaimer, the term of this patent is extended or adjusted under 35 U.S.C. 154(b) by 0 days.

(21) Appl. No.: 09/958,902

(22) PCT Filed: Mar. 7, 2000

(86) PCT No.: PCT/EP00/01964

§ 371 (c)(1),
(2), (4) Date: Jan. 11, 2002

(87) PCT Pub. No.: WO00/62003

PCT Pub. Date: Oct. 19, 2000

(30) Foreign Application Priority Data

Apr. 13, 1999 (DE) ..... 199 16 475

(51) Int. Cl.[7] ..... F28F 9/00; F28F 7/00; F24H 3/02; B60K 11/04

(52) U.S. Cl. ..... 165/67; 165/80.1; 165/121; 180/68.4

(58) Field of Search ..... 165/67, 68, 121, 165/122, 76, 80.1; 180/68.4

(56) References Cited

U.S. PATENT DOCUMENTS

| | | | | |
|---|---|---|---|---|
| 4,315,540 A | | 2/1982 | Moranne | 165/67 |
| 4,651,816 A | | 3/1987 | Struss et al. | 165/76 |
| 4,805,868 A | * | 2/1989 | Claude | 165/122 |
| 4,955,434 A | * | 9/1990 | Price | 165/122 |
| 5,219,016 A | * | 6/1993 | Bolton et al. | 165/67 |
| 5,287,940 A | * | 2/1994 | Ogawa et al. | 180/68.4 |
| 5,476,138 A | | 12/1995 | Iwasaki et al. | 165/41 |
| 5,671,803 A | * | 9/1997 | Tepas et al. | 165/67 |
| 5,704,418 A | * | 1/1998 | Badder et al. | 165/121 |
| 5,720,341 A | | 2/1998 | Watanabe et al. | 165/135 |
| 5,819,841 A | | 10/1998 | Moynat | 165/78 |
| 5,875,836 A | * | 3/1999 | Nakamura | 165/122 |

FOREIGN PATENT DOCUMENTS

| | | |
|---|---|---|
| DE | 34 04 887 | 8/1985 |
| DE | 91 14 734 | 3/1992 |
| DE | 41 37 038 | 6/1993 |
| DE | 43 30 214 | 3/1995 |
| DE | 195 08 112 | 9/1996 |
| DE | 196 49 129 | 5/1998 |
| DE | 198 28 362 | 12/1999 |
| EP | 0 020 190 | 12/1980 |
| EP | 0 970 833 | 1/2000 |
| FR | 2 742 495 | 6/1997 |
| JP | 58-036723 | 3/1983 |
| WO | 97/42049 | 11/1997 |

OTHER PUBLICATIONS

Patent Abstracts of Japan, "Radiator Installing Structure", by Yasuaki, Publ. 10018843, Jan. 20, 1998.

* cited by examiner

*Primary Examiner*—Henry Bennett
*Assistant Examiner*—Tho V Duong
(74) *Attorney, Agent, or Firm*—Foley & Lardner

(57) ABSTRACT

The invention relates to a heat transmission unit for a motor vehicle, comprising a fan cowling (12) and at least one heat exchanger (14) connected thereto. In order to provide an improved heat transmission unit which can be especially produced in an economical manner an which enables easy connection to the heat exchanger to the fan cowling especially during pre-assembly of the cooling module, the heat exchanger (14) is maintained on the fan cowling (12) by means of its manifolds (18, 20).

11 Claims, 2 Drawing Sheets

HEAT TRANSMISSION UNIT FOR A MOTOR VEHICLE

The invention relates to a heat transmission unit for a motor vehicle according to the preamble of claim 1.

Such a heat transmission unit, in which a radiator of the motor vehicle, a compensating container of the radiator, a fan cowling and a grille are pre-assembled to form a compact cooling unit, is known from DE 34 04 887. The whole, pre-assembled unit can then be inserted into the motor vehicle. The radiator and the fan cowling are accordingly designed so as to be interconnectable. To this end, the radiator and the fan cowling have various holding devices, holding frames and holding brackets which are held together via clamps or clips. Such combination and connection of the individual components is relatively complicated and correspondingly unfavorable in terms of cost.

For mounting and connecting a condenser of an air-conditioning system with a fan cowling, it is known from the Mercedes-Benz W202 vehicle to attach mountings to what may be referred to as the condenser network, which is made up of flat tubes and undulating ribs, the mountings being riveted on through the condenser network. This method can easily result in damage to the flat tubes adjacent to a rivet. The mountings also disadvantageously reduce the area through which the air can flow freely. The riveted-on mountings are moreover unfavorable in terms of cost.

On the basis of this state of the art, the object of the invention is to avoid the abovementioned disadvantages and to provide an improved heat transmission unit which in particular can be manufactured cost-effectively and makes possible simple connection of the heat exchanger to the fan cowling.

This object is achieved by a heat transmission unit having the features of claim 1.

According to the invention, the heat exchanger is retained via its manifolds on the fan cowling, so that no additional holding brackets or holding frames are necessary. By means of this simplified mounting, the assembly of heat exchanger and fan cowling is simplified, and the manufacturing and production costs are reduced. Furthermore, the entire air afflux area of the heat exchanger can be flowed through freely, since there are no fastening points within the network consisting of ribs and tubes of the heat exchanger.

The heat exchanger is preferably a cooling-agent condenser or a gas cooler of an air-conditioning system of the motor vehicle, since, in the configuration according to the invention, this can then, in combination with the fan cowling and a coolant radiator, be especially simply pre-assembled to form a cooling module and retained within the module.

Most simply, the mounting is formed by clips which are arranged on the fan cowling and into which the heat exchanger can be clipped by its manifolds. All that is necessary then is for the fan cowling to have appropriate clips, and the heat exchanger can be attached simply, rapidly and correspondingly cost-effectively to the fan cowling in pre-assembly. The heat exchanger does not need to have any additional fastening means.

In one configuration of the invention, at least one manifold is bent at its ends, and the ends can be passed through openings provided in the fan cowling and can be fixed in the openings by a securing means. In this way, an especially functionally reliable connection between the heat exchanger and the fan cowling is produced, which cannot come loose by itself.

In order further to simplify pre-assembly, in another configuration of the invention, the heat exchanger can be inserted, by at least one of the manifolds, into a pocket-like receptacle of the fan cowling and can be fixed by at least one fastening means, for example a clip, at another location on the fan cowling. All that is necessary then for assembly is for the heat exchanger to be inserted into the receptacle and clipped in by pivoting.

The invention is explained in detail below by means of illustrative embodiments with reference to the drawing, in which FIG. 1 shows a heat transmission unit according to the invention seen in the air afflux direction;

Figure 1:
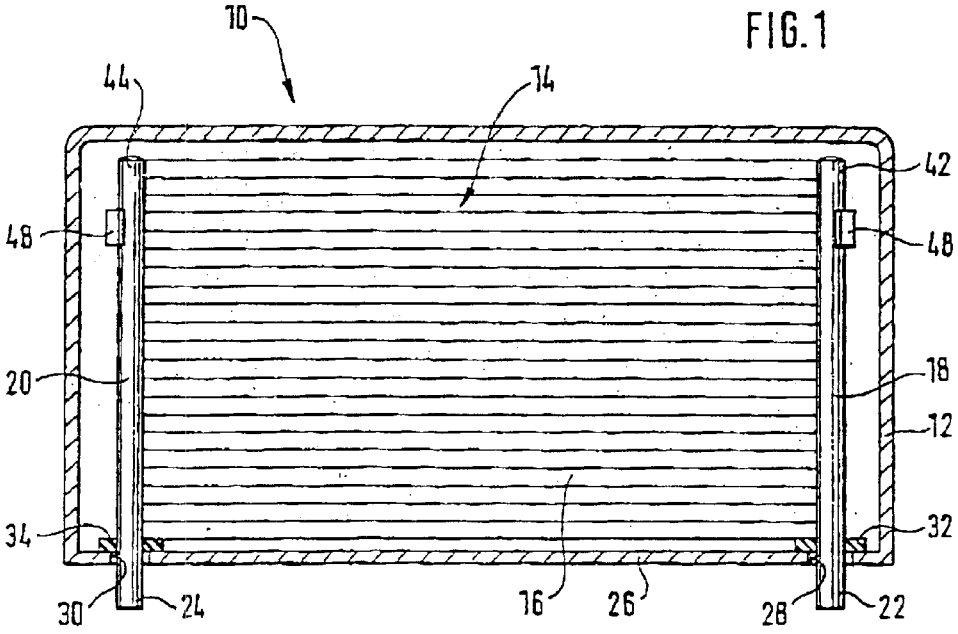

A heat transmission unit 10 illustrated in the drawing has a fan cowling 12 and at least one heat exchanger 14. The heat exchanger 14 serves for the heat exchange between air, which is supplied by a fan (not illustrated) arranged on the fan cowling, and a fluid, for example a cooling agent of a vehicle air-conditioning system. The heat exchanger 14 is preferably designed using the flat tube construction method, the flat tubes and undulating ribs arranged between the flat tubes forming what may be referred to as a heat exchanger network 16. The flat tubes extend between two manifolds 18 and 20.

The heat exchanger 14 is preferably a flat tube condenser with an overall depth of roughly 8–12 mm. The diameter of the manifolds 18 and 20 is preferably smaller than or equal to the overall depth of the heat exchanger network 16. The flat tubes are then, in a known manner, twisted at their ends at which they are connected to the manifolds 18 and 20, as is known from, for example, DE 196 49 129.

According to the invention, the heat exchanger 14 is retained via its manifolds 18 and 20 on the fan cowling 12. In a first illustrative embodiment according to FIG. 1, the manifolds 18 and 20 are to this end retained by their lower ends 22 and 24 in a bottom 26 of the fan cowling 12. This can be effected by, for example, the ends 22 and 24 being insertable into openings 28 and 30, the network 16 resting on the bottom 26 via support elements 32 and 34 which consist of, for example, rubber (FIG. 1).

Figure 4:
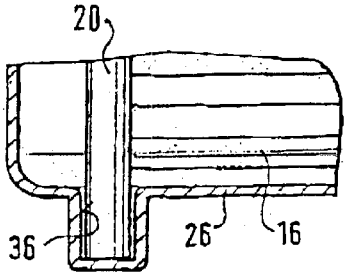
FIGS. 4 and 5 show connections of the heat transmission unit to the fan cowling, the manifold of the heat exchanger being mounted in pocket-like receptacles.
Figure 5:
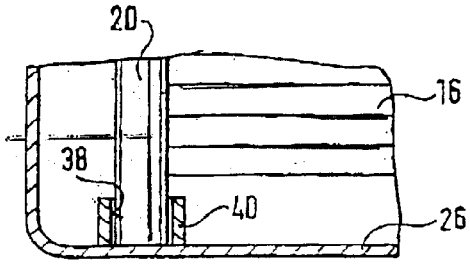

In alternative embodiments, the mounting of the lower ends 22 and 24 of the manifolds 18 and 20 can be effected by the bottom 26 of the fan cowling 12 having appropriate pocket-like receptacles 36 (FIG. 4) or 38 (FIG. 5). In this connection, the pocket-like receptacle 36, 38 can be in the form of an outward shaping of the bottom 26 (FIG. 4) or a sleeve 40 which is applied to the bottom 26 and into which the end of the manifold can be inserted, as illustrated in FIG. 5.

Figure 2:
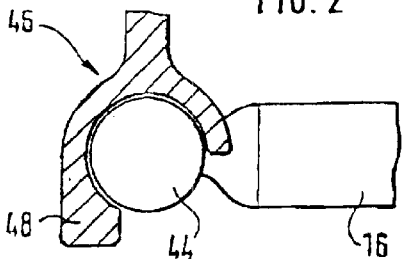
FIGS. 2 and 3 show heat exchanger/fan cowling connection possibilities.
Figure 3:
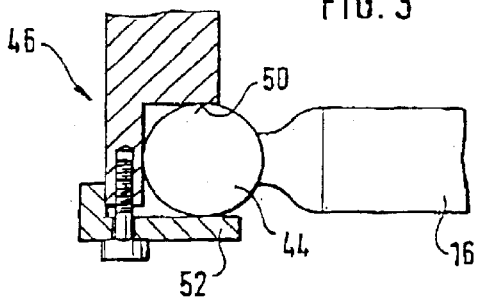

The manifolds 18 and 20 are retained on the fan cowling 12 by their upper ends 42 and 44 via suitable fastening devices 46. Embodiments of the fastening device 46 are illustrated in FIGS. 2 and 3. According to FIG. 2, the fastening device 46 is designed as a clip connection, the upper ends 42 and 44 simply being clippable into corresponding clips 48 of the fan cowling 12. All that is necessary then for pre-assembly of the heat transmission unit 10 is to insert the heat exchanger 14 into the bottom 26 of the fan cowling and to clip it in a simple manner into the clips 48 by slight pivoting, as a result of which the heat exchanger 14 is connected firmly to the fan cowling 12.

In the alternative embodiment of the fastening device 46 according to FIG. 3, the upper ends 42 and 44 of the manifolds 18 and 20 can also be screwed together with the fan cowling, to which end the fan cowling 12 has stops 50 for the upper ends 42 and 44, and the ends 42 and 44 are retained in contact against the stop 50 by a holding element 52 which can be screwed together with the stop 50.

Figure 6:
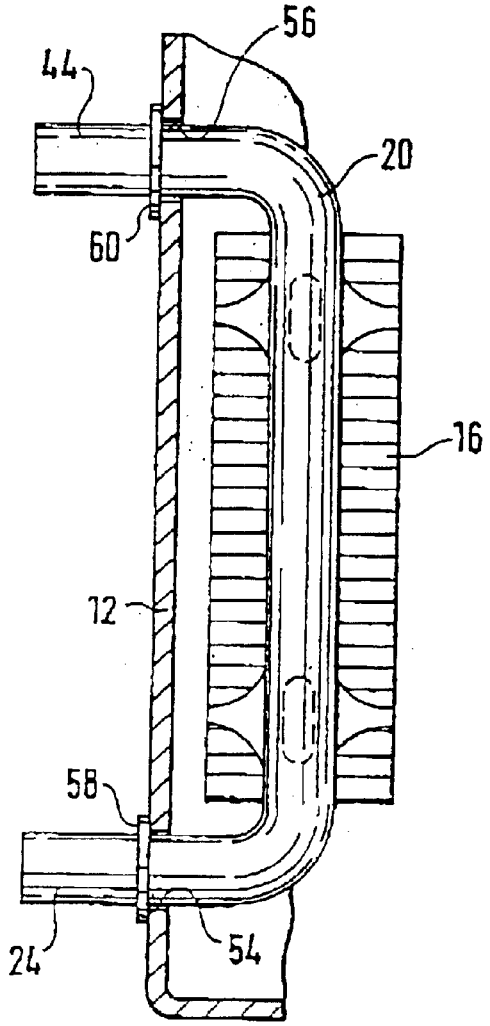
FIG. 6 shows another heat transmission unit, in which one manifold of the heat exchanger is bent at its ends.

In another embodiment of the invention (FIG. 6), the ends 24, 44 of at least one 20 of the manifolds, but preferably of both manifolds, are bent by preferably roughly 90°, so that the bent ends 42, 44 can be passed through openings 54, 56 provided in the fan cowling 12 and can be fixed in the openings 54, 56 by a securing means 58, 60, for example a snap ring. All that is necessary then for assembly of the heat transmission unit 10 is to insert the manifold ends of the heat exchanger 14 into the fan cowling 12 and to apply the securing means 58 and 60 to the ends 42, 44 of the manifolds, which have been passed through the openings 54 and 56.

Figure 7:
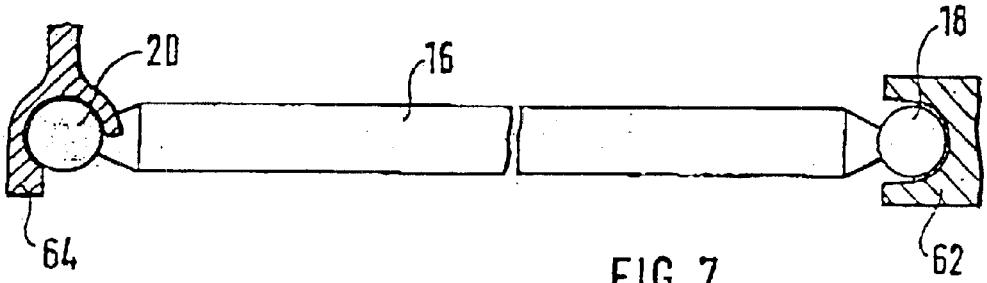
FIG. 7 shows another heat transmission unit.

In another embodiment of the invention according to FIG. 7, one 18 of the manifolds is, preferably over roughly its entire length, inserted into and retained in a pocket-like mounting 62, while the other manifold 20 is retained via at least one clip 64 on the fan cowling 12. During assembly of the heat transmission unit 10 in this embodiment, the pocket-like receptacle 62 acts like a hinge, so that, when the heat exchanger 14 is inserted, it is first inserted into the pocket-like receptacle 62 and then, like a door, can be fixed by pivoting about the longitudinal axis of the manifold 18 and pressing the manifold 20 against the clip 64.

A great many further possibilities are conceivable. For example, the heat exchanger could be retained by its manifolds on the fan cowling exclusively by clips. It would also be possible not to insert the lower ends of the manifolds into pocket-like receptacles, but instead to insert the upper ends, and simply to clip the lower ends in on the fan cowling.

What is claimed is:

1. A heat transmission unit for a motor vehicle comprising:

a fan cowling (12) which comprises a bottom portion (26); and at least one heat exchanger (14) connected thereto;

wherein the heat exchanger (14) is retained on the fan cowling (12) via manifolds (18, 20) of the heat exchanger (14) which have been inserted into openings (28,30) in a bottom portion (26) of the fan cowling (12);

wherein a mounting is formed by clips (48) which are arranged on the fan cowling (12) and into which the heat exchanger (14) can be clipped by its manifolds (18, 20).

2. The heat transmission unit as claimed in claim 1, characterized in that the heat exchanger (14) is a cooling-agent condenser or a gas cooler of an air-conditioning system of flat tube construction.

3. The heat transmission unit as claimed in claim 1, characterized in that the diameter of the manifolds (18, 20) is smaller than or equal to a block depth of the heat exchanger (14).

4. The heat transmission unit as claimed in claim 3, characterized in that the block depth is roughly 12 mm.

5. A heat transmission unit comprising:

(a) a fan cowling comprising:

(i) a bottom portion with an opening therein; and (ii) a clip; and (b) at least one heat exchanger comprising:

(i) a heat exchanger network; and (ii) a manifold which comprises an upper end and a lower end;

wherein the upper end of the manifold is clipped to the cowling via the clip and the lower end of the manifold is inserted in the opening in the bottom portion of the cowling.

6. A heat transmission unit according to claim 5, wherein the heat exchanger network comprises flat tubes and undulating ribs arranged between the flat tubes.

7. A heat transmission unit according to claim 6, wherein the flat tubes extend between a first manifold and a second manifold.

8. A heat transmission unit according to claim 5, wherein the heat exchanger network rests on the bottom portion of the fan cowling.

9. A heat transmission unit according to claim 5, further comprising a support element wherein the heat exchanger network rests on the support element and the support element rests on the bottom portion of the fan cowling.

10. A heat transmission unit according to claim 5, wherein the heat exchanger comprises a flat tube condenser with an overall depth of 8–12 mm.

11. A heat transmission unit according to claim 5, wherein the diameter of the manifold is smaller than or equal to the depth of the heat exchanger.

* * * * *